United States Patent [19]

Duclos

[11] 4,444,392

[45] Apr. 24, 1984

[54] GOLF DRIVER CLUB HEAD

[76] Inventor: Clovis R. Duclos, 6327 Marina Pacifica Dr., Long Beach, Calif. 90803

[21] Appl. No.: 398,970

[22] Filed: Jul. 16, 1982

[51] Int. Cl.[3] ..... A63B 53/04

[52] U.S. Cl. ..... 273/77 A; 273/167 E; 273/167 H; 273/169

[58] Field of Search ..... 273/167 E, 167 H, 77 A, 273/169, 171, 172, 170, 167 A

[56] References Cited

U.S. PATENT DOCUMENTS

D. 246,329 11/1977 Little ..... 273/167 H X 3,468,544 9/1969 Antonious ..... 273/167 E X 3,794,328 2/1974 Gordon ..... 273/167 E 4,214,754 7/1980 Zebelean ..... 273/167 H

*Primary Examiner*—George J. Marlo

*Attorney, Agent, or Firm*—George W. Finch

[57] ABSTRACT

An improved driver club head for the game of golf including an internal cavity which communicates with a shaped slot in the rear of the head to provide a short-term dynamic alleviation of the base aerodynamic drag of the head when it is being swung. The head can be manufactured from traditional materials such as wood, but in its preferred embodiments, it is constructed from metal or composite materials.

9 Claims, 6 Drawing Figures

GOLF DRIVER CLUB HEAD

CROSS REFERENCE TO RELATED APPLICATION

This application is related to U.S. Design Pat. Application Ser. No. 367,530 entitled "Golf Driver Head Set" by Clovis P. Duclos. The teachings of that application are hereby incorporated by reference as though fully set forth hereinbelow.

BACKGROUND OF THE INVENTION

In the game of golf, drivers are used when it is desired to hit the golf ball as far as possible. This is accomplished by providing a fairly long heavy club which traditionally appears "spoon-shaped" from the top. This "spoon-shaping" is an adaption that recognizes that when an individual is swinging such a club, the aerodynamic drag thereof becomes an appreciable resistive force preventing high club speed. High club head speed is desired so that as much energy as possible is imparted into the golf ball to prolong its flight. Various shapes and configurations of driver club heads have been used to reduce this aerodynamic drag by "boat-tailing" the rear of the head to reduce its base drag, the frontal surface of the club having to the flat for functional purposes. Unfortunately, weight, angle of attack, and mechanical limitations prevent a driver head from having a sufficiently long trailing edge to reduce a large proportion of the base drag. Also, conventionally shaped club heads are difficult to produce in materials other than wood such as metal or composite, since cavities must be provided therein so that the head does not have excessive mass. The production of these cavities requires expensive molding techniques employing multiple inserts and additional manufacturing operations. Therefore, there has been a need to provide a driver club with improved aerodynamic characteristics which can be constructed from metal or composite materials thus alleviating the problems of quality control with an inexact material such as wood while reducing the production cost thereof.

BRIEF DESCRIPTION OF THE INVENTION

Golf driver club heads of the present invention each have a cavity therein which communicates with the rear of the head by means of a shaped slot so that in the dynamic environment of a golf club swing, the base drag of the club is dynamically relieved first by reduced frontal area presented during the initial portions of the swing and then later by flow of air out of the cavity into the region of separated flow behind the head during the later portions of the swing until impact with the golf ball. The cavity also reduces the volume of material required to construct the head so that it can be formed from metallic materials which increases durability and reduce maintenance thereon.

It is therefore the principal object of the present invention to provide a golf driver head whose base drag is reduced so that a given player can generate higher club head speed at golf ball engagement than would otherwise be possible.

Another object is to provide a golf driver head which can be constructed relatively economically out of metallic or composite materials.

Another object is to provide an aerodynamic improvement to a set of golf driver heads without adversely affecting the styling thereof Another object is to provide increased manufacturing economy for metal or composite driver club heads especially those heads traditionally having higher loft angles on the faces thereof.

These and other objects and advantages of the present invention will become apparent to those skilled in the art after considering the following detailed specification which covers preferred embodiments thereof in conjunction with the accompanying drawing wherein:

DETAILED DESCRIPTION OF THE SHOWN EMBODIMENT

Figure 1:
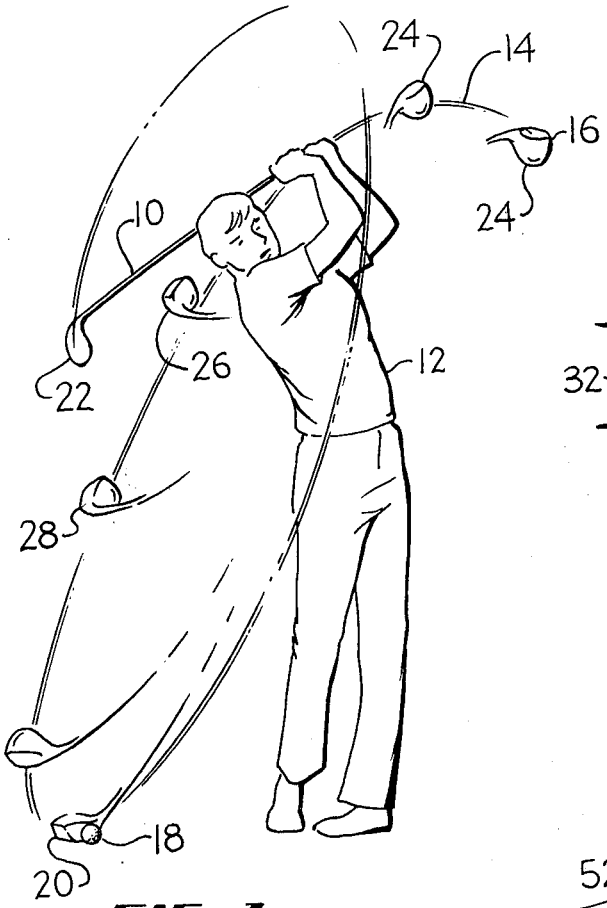
FIG. 1 is an action view of a golfer swinging a driver club through its normal arc.
Figure 2:
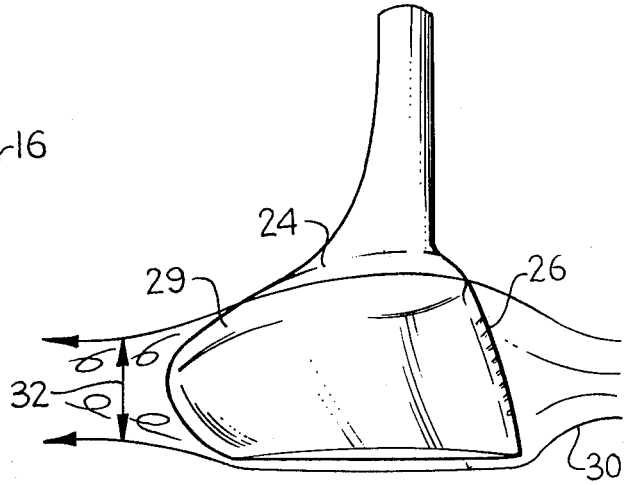
FIG. 2 PRIOR ART
FIG. 2 is a side view of a typical prior art golf driver head showing the relative airflow thereabout.

Referring to the drawing more particularly by reference numbers, number 10 in FIG. 1 refers to a golf driver club being swung by a golfer 12 through its usual arc 14 from the set position 16 from which the motion to strike the ball 18 traditionally commences, through the ball impact position 20 to the finish position 22 shown in full figure. The golf club 10 includes a generally "spoon-shaped" head 24 having a flat front surface 26 for impact with the ball 18. As the club 10 is swung from the position 16 about the arc 14, it is gradually accelerated until it reaches its maximum velocity at position 20. Generally, from position 28 to position 20 the aerodynamic drag of the club head 24 becomes a primary resistive force to club head acceleration and thus the energy that can be imparted to the ball 18 at the position 20 of impact. Prior to that point, the front surface 26 of the head 24 is more parallel than perpendicular to the arc 14. As shown in FIG. 2, traditional driver club heads 24 have a smooth rear curvature 29 past the relatively flat front face 26 in an attempt to reduce aerodynamic drag. However, various considerations prevent proper streamlining. For example, as should be obvious from FIG. 1, the club head 24 does not maintain a constant angle of attack with respect to the relative wind 30, but instead twists due to the physical mechanics of the motion of the golfer 12. Therefore, for the portion of the swing from position 16 to 28 the front face 26 is sidewardly with respect to the relative wind 30. However, from position 28 to position 20 the airflow gradually becomes that shown in FIG. 2 where because of the shape of the head 24, a large base drag area 32 is created behind the club head 24 which resists acceleration thereof.

Figure 3:
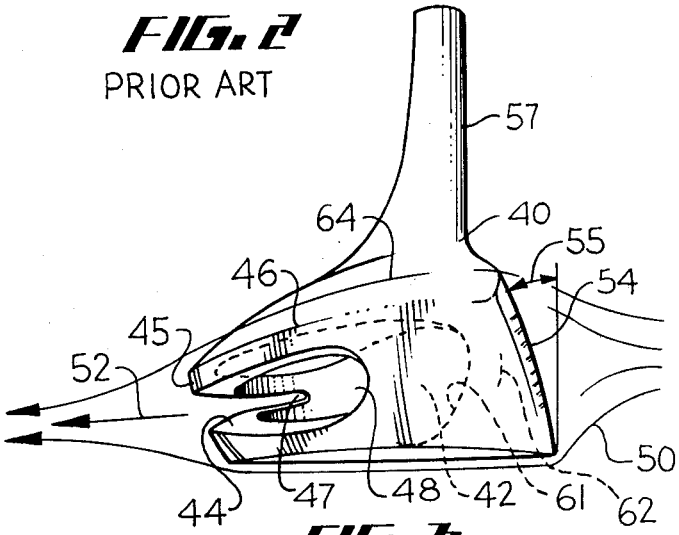
FIG. 3 is a side view similar to FIG. 2 of the golf driver head of the type traditionally having a low loft angle constructed according to the present invention.

In the present head 40 as shown in FIG. 3, a cavity 42 is provided within the club head 40 which opens rearwardly through a shaped slot 44. The slot 44 extends around the periphery 45 of the rear 46 of the club 40 so that when the club 40 is moving from position 16 to position 28 in FIG. 1, less frontal area is presented to the relative wind than occurs when the traditional club 24 is swung. The slot 44 is wider at the outer portion 48 thereof than at the inner portion 47 thereof. Thereafter, the relative wind 50 is more like that shown in FIG. 3, and air within the cavity 42 in the quick dynamic environment of the club swing from position 28 to 20 moves as shown by arrow 52 into what would otherwise be the base drag area 32 to reduce the base drag of the club head 40. This enables an increase in club speed which is desirable so that more energy can be imparted from the front face 54 thereof to the ball 18 than can occur with the slower traditional club head 24.

Figure 4:
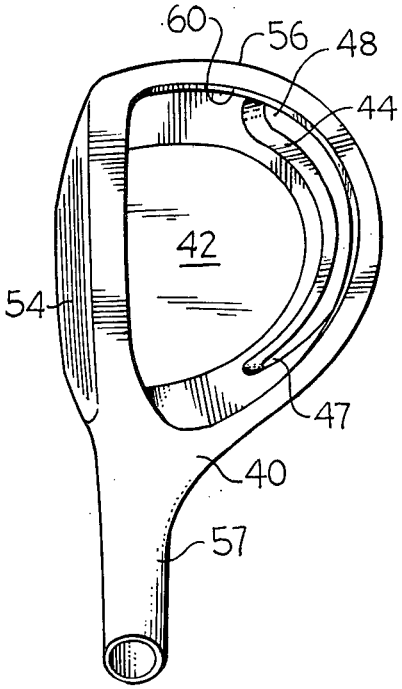
FIG. 4 is a top view of the club of FIG. 3 during an intermediate assembly step showing the cavity therein.
Figure 5:
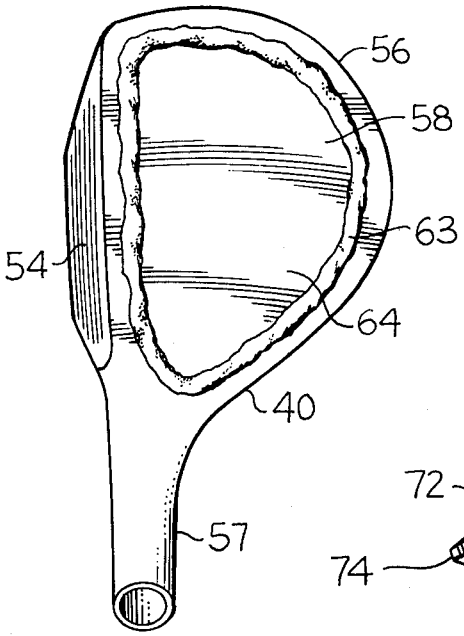
FIG. 5 is a top view similar to FIG. 4 of the club of FIG. 4 once the top has been welded thereto.

FIGS. 3, 4 and 5 shown a construction typical of a #1 head which traditionally has a low loft angle 55 and is the longest hitting club normally carried by a golfer. The head 40 can be cast in two pieces. The body piece 56 includes the front surface 54 and the hosel 57 and is shown in FIG. 4 and the top piece 58 is shown in combination therewith in FIG. 5. Having the opening 60 and the slot 44 allows relatively easy casting of the club head 40 with the cavity 42 shaped as shown in FIGS. 3 and 4 with a upwardly sloping front face 61 which causes a triangular volume 62 to lower the center of gravity of the head 40. The opening 60 is closed by the cap member 58, which when the head 40 is constructed from metal, is welded thereto as shown by the weld 63 which exists prior to grinding the top 64 of the club 40 smooth as shown in FIG. 3.

Figure 6:
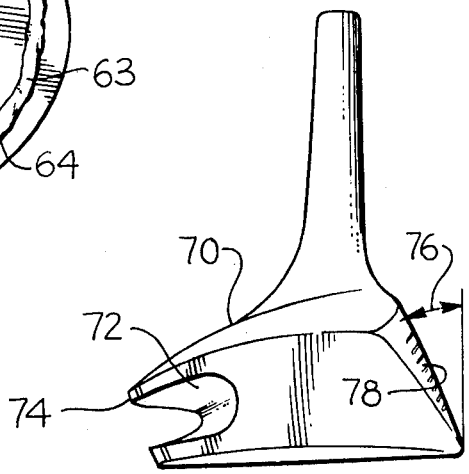
FIG. 6 is a golf driver head of the type traditionally having a high loft angle constructed according to the present invention.

This construction method is not required for driver heads conventionally numbered 5 or 7 having relatively high loft angles since such clubs are traditionally smaller requiring less cavity 42 to provide the aerodynamic improvement. The smaller head size also reduces the requirement to enlarge the cavity 42 to keep the mass of the club head below an undesirable level. A#7 head 70 is shown in FIG. 6 wherein a shallow cavity 72 is provided in the rear periphery 74 of the club head 70 to impart the aerodynamic advantages of the cavity 42 and slot 44 although to a lesser extent. As can be seen, the head 70 has a larger loft angle 76 of its front surface 78 than head 40. When a set of heads is provided, the volume of the cavities thereof decreases from just more than one half the total volume of the head to much less than one half of the total volume with increasing loft angles of the front surfaces thereof. The manufacture of the head 70 is more economic than the manufacture of the head 40 because it can be molded in one piece not requiring the additional operations of molding the cap member 58 and then welding it on the body piece 56.

Thus there has been shown and described improved golf driver heads which fulfill all the objects and advantages sought therefor. Many changes, modifications, variations, other uses and applications of the subject invention will, however, become apparent to those skilled in the art after considering this specification together with the accompanying drawing and claims. All such changes, modifications, variations, other uses and applications which do not depart from the spirit and scope of the invention are deemed to be covered by the invention which is limited only by the claims which follow.

What is claimed is:

1. A golf driver head having: a closed front impact surface adapted for striking a golf ball;

a hosel adjacent one side of said front impact surface for engagement with a golf club shaft;

a rear surface;

an interior cavity isolated from said closed front impact surface; and a slot communicating said interior cavity through said rear surface whereby air entrapped within said internal cavity can flow through said slot to any area of reduced pressure adjacent said rear surface.

2. The golf driver head defined in claim 1 wherein said slot has a relative narrow end adjacent said hosel and a relatively wide end spaced from said hosel.

3. The golf driver head defined in claim 1 wherein said interior cavity has a sloped interior fron surface adjacent said hosel so that a triangular solid volume is defined between said front impact surface and said sloped interior front surface.

4. The golf driver head defined in claim 1 wherein said head is contructed from moldable material.

5. The golf driver head defined in claim 4 wherein said head is constructed from:

first and second molded metal pieces, said first piece including said hosel, said slot, said front impact surface and a top opening above said interior cavity, and said second piece being shaped to nest in said top opening; and a weld bead connecting said first and second metal pieces.

6. The golf driver head defined in claim 1 wherein said interior cavity has a volume that is at least one half the volume of the head.

7. A golf driver head set of at least two different heads, each head in said set having:

a closed front impact surface adapted for striking a golf ball, said front impact surface having a loft angle which is different for each head in said set;

a hosel adjacent one side of said front impact surface for engagement with a golf club shaft;

a rear surface;

an interior cavity aerodynamically isolated from said closed front impact surface; and a slot communicating said interior cavity through said rear surface.

8. The golf driver head set defined in claim 7 wherein each of said slots has a relative narrow end adjacent said hosel and a relatively wide end spaced from hosel.

9. The golf driver head set defined in claim 7 wherein each of said interior cavities defines different volumes so that heads having higher loft angles have smaller defined cavity volumes.

* * * * *